US010041279B2

(12) United States Patent
Rosales et al.

(10) Patent No.: US 10,041,279 B2
(45) Date of Patent: Aug. 7, 2018

(54) MOTOR VEHICLE LOCK

(71) Applicant: Brose Schliesssysteme GmbH & Co. KG, Wuppertal, Wuppertal (DE)

(72) Inventors: David Rosales, Rochester Hills, MI (US); Michael Wittelsbuerger, Lake Orion, MI (US)

(73) Assignee: Brose Schliesssysteme GmbH & Co. Kommanditgesellschaft, Wuppertal (DE)

( * ) Notice: Subject to any disclaimer, the term of this patent is extended or adjusted under 35 U.S.C. 154(b) by 0 days.

(21) Appl. No.: 14/030,833

(22) Filed: Sep. 18, 2013

(65) Prior Publication Data

US 2015/0076837 A1 Mar. 19, 2015

(51) Int. Cl.

| | |
|---|---|
| ***E05C 3/16*** | (2006.01) |
| ***E05B 77/36*** | (2014.01) |
| ***E05B 77/42*** | (2014.01) |
| ***E05B 77/04*** | (2014.01) |
| ***E05B 77/38*** | (2014.01) |
| ***E05B 85/26*** | (2014.01) |

(52) U.S. Cl.

CPC ..... *E05B 77/36* (2013.01); *E05B 77/04* (2013.01); *E05B 77/38* (2013.01); *E05B 77/42* (2013.01); *E05B 85/26* (2013.01); *Y10T 292/1078* (2015.04)

(58) Field of Classification Search

CPC ..... E05B 77/36; E05B 77/38; E05B 77/04; E05B 77/42; E05B 85/26; Y10T 292/1078

USPC .. 292/201, 216, DIG. 23, DIG. 22, DIG. 42, 292/100, 200, 198

See application file for complete search history.

(56) References Cited

U.S. PATENT DOCUMENTS

| | | | | |
|---|---|---|---|---|
| 2,646,299 | A * | 7/1953 | Kramer | E05B 83/16 292/229 |
| 3,345,100 | A * | 10/1967 | Kramer | 292/48 |
| 3,394,956 | A * | 7/1968 | Zaydel | 292/201 |
| 3,905,624 | A * | 9/1975 | Fujita | 292/11 |

(Continued)

FOREIGN PATENT DOCUMENTS

| | | | |
|---|---|---|---|
| DE | 102010061518 | | 4/2012 |
| EP | 1710378 | A2 * | 10/2006 |

(Continued)

OTHER PUBLICATIONS

Extended European Search Report for European Patent Application No. 14185461.2, dated Jul. 3, 2015 (6 pages).

*Primary Examiner* — Kristina Fulton
*Assistant Examiner* — Christine M Mills
(74) *Attorney, Agent, or Firm* — Pauly, DeVries, Smith & Deffner LLC

(57) ABSTRACT

The invention is directed to a motor vehicle lock for a motor vehicle door arrangement, wherein a pivotable catch and an inlet mouth for a lock striker are provided, wherein the catch can be brought into at least one closed position and into at least one open position, wherein the catch as such in its closed position may hold the lock striker by a holding engagement between the catch and the lock striker and in its open position may release the lock striker, wherein during a closing cycle the lock striker comes into an actuating engagement with the motor vehicle lock such that the catch moves from its open position into the direction of its closed position, preferably into its closed position.

27 Claims, 2 Drawing Sheets

(56) References Cited

U.S. PATENT DOCUMENTS

| | | | | | |
|---|---|---|---|---|---|
| 4,875,724 | A | * | 10/1989 | Gruber | 292/216 |
| 4,889,371 | A | * | 12/1989 | Girard et al. | 292/201 |
| 4,936,611 | A | * | 6/1990 | Palvolgyi | 292/28 |
| 5,117,665 | A | * | 6/1992 | Swan | E05B 77/265 292/48 |
| 7,686,355 | B2 | * | 3/2010 | Jankowski et al. | 292/336.3 |
| 2006/0006669 | A1 | * | 1/2006 | Nelsen et al. | 292/216 |

FOREIGN PATENT DOCUMENTS

| | | |
|---|---|---|
| EP | 1867808 | 5/2009 |
| FR | 2488935 | 2/1982 |
| FR | 2848235 | 6/2004 |
| JP | 04293875 | 10/1992 |
| WO | 0181695 | 11/2001 |

* cited by examiner a)

b)

MOTOR VEHICLE LOCK

FIELD OF THE INVENTION

The invention is directed to a motor vehicle lock.

BACKGROUND

The motor vehicle lock in question is assigned to a motor vehicle door arrangement which comprises at least a motor vehicle door. The expression "motor vehicle door" is to be understood in a broad sense. It includes in particular side doors, back doors, lift gates, trunk lids or engine hoods. Such a motor vehicle door may generally be designed as a sliding door as well.

The acoustic characteristic of the motor vehicle lock in question is of importance today, as such acoustic characteristic may considerably decrease the operating comfort. Subject of the present discussion is the acoustic characteristic during the closing cycle of the motor vehicle lock.

The known motor vehicle lock (EP 1 867 808 B1) comprises a pivotable catch and a pivotable pawl assigned thereto. The motor vehicle lock further comprises an inlet mouth for a lock striker. Usually the motor vehicle lock is arranged at a door of the motor vehicle door arrangement, while the lock striker is arranged at the body of the motor vehicle. The catch can be brought into a main closed position and into a preliminary closed position, in which the catch may hold the lock striker by a holding engagement between the catch and the lock striker. In its open position the catch releases the lock striker.

During a closing cycle, which is initiated by a closing movement of the door of the motor vehicle door arrangement, the striker comes into an actuating engagement with the catch such that the catch moves from its open position into its respective closed position.

The known motor vehicle lock has proved to be reliable and easy to manufacture. However, the actuating engagement between the lock striker and the catch requires constructional measures for reducing the resulting impact noise. Such measures are, for example, the coating of the catch by a damping material.

It is the object of the invention to improve the known motor vehicle lock such that the acoustic characteristic during a closing cycle of the motor vehicle lock is improved.

SUMMARY OF THE INVENTION

The above noted object is solved for a motor vehicle lock according to the present disclosure.

The basic idea underlying the present invention is to provide an actuating element that, during a closing cycle of the motor vehicle lock, interacts with the lock striker instead of the catch itself. It has been discovered that with a proper coupling between the actuating element and the catch it is possible to considerably decrease the impact noise during the closing cycle of the motor vehicle lock. In particular, a coating of the catch with damping material is not necessary, as far as the closing cycle is concerned.

In an embodiment, a motor vehicle lock for a motor vehicle door arrangement is provided, wherein a pivotable catch and an inlet mouth for a lock striker are provided, wherein the catch can be brought into at least one closed position and into at least one open position, wherein the catch as such in its closed position may hold the lock striker by a holding engagement between the catch and the lock striker and in its open position may release the lock striker, wherein during a closing cycle the lock striker comes into an actuating engagement with the motor vehicle lock such that the catch moves from its open position into the direction of its closed position, preferably into its closed position, wherein an actuating element is provided, which is displaceable relative to the catch and which is or may be drivingly coupled to the catch, which coupling provides a transmission gearing, in particular a lever gearing, such that during the closing cycle the actuating engagement of the lock striker with the actuating element causes driving the catch from its open position into the direction of its closed position, preferably into its closed position, for establishing the holding engagement between the catch and the lock striker.

In further detail an actuating element is provided, which is displaceable relative to the catch and which is or may be drivingly coupled to the catch, which coupling provides a transmission gearing, in particular a lever gearing, such that during the closing cycle the actuating engagement of the lock striker with the actuating element causes driving the catch from its open position into the direction of its closed position, preferably into its closed position, for establishing the holding engagement between the catch and the lock striker.

With the proposed solution it is possible to have the lock striker engage the actuating element before the lock striker engages the catch. As the first engagement between the lock striker and the actuating element may easily be laid out for noise reduction taking into account the possible effect of the transmission gearing, the resulting overall acoustic characteristic may be optimized considerably.

It has further been found that with the proposed actuating element it is possible to reduce the necessary pivot angle range of the catch significantly, which increases the freedom in construction. For example it is possible to provide the catch with a basically hook shaped design, which allows a high degree of mechanical stability with comparably little material usage. Also the small pivot angle range leads to a simplification of a spring bias for the catch which spring bias will be explained later.

Depending on the application the catch may be provided with a pivotable pawl. This has proven to be a reliable and simple way to block the catch in its closed position.

An embodiment provides a preferred embodiment which is optimized in view of an improved crash safety that is achieved with low additional constructional effort. In a preferred embodiment it is proposed that the pawl itself provides part of a crash support arrangement.

Various embodiments are directed to the transmission gearing. In particular this transmission gearing is designed such that low actuating forces acting from the lock striker on the actuating element are sufficient to move the catch from the open position into the closed position. In a constructionally simple variant the transmission gearing is a simple lever gearing.

An example embodiment is directed to a motor vehicle lock for a motor vehicle door arrangement, wherein a pivotable catch and an inlet mouth for a lock striker are provided, wherein the catch can be brought into at least one closed position and into at least one open position, wherein the catch as such in its closed position may hold the lock striker by a holding engagement between the catch and the lock striker and in its open position may release the lock striker, wherein during a closing cycle the lock striker comes into an actuating engagement with the motor vehicle lock such that the catch moves from its open position into the direction of its closed position, preferably into its closed position. It is proposed that an actuating element is provided, which is displaceable relative to the catch and which is or may be drivingly coupled to the catch, which coupling provides a transmission gearing, in particular a lever gearing, such that during the closing cycle the actuating engagement of the lock striker with the actuating element causes driving the catch from its open position into the direction of its closed position, preferably into its closed position, for establishing the holding engagement between the catch and the lock striker.

In the following the invention will be described in an example referring to the drawings.

DETAILED DESCRIPTION

Figure 1:
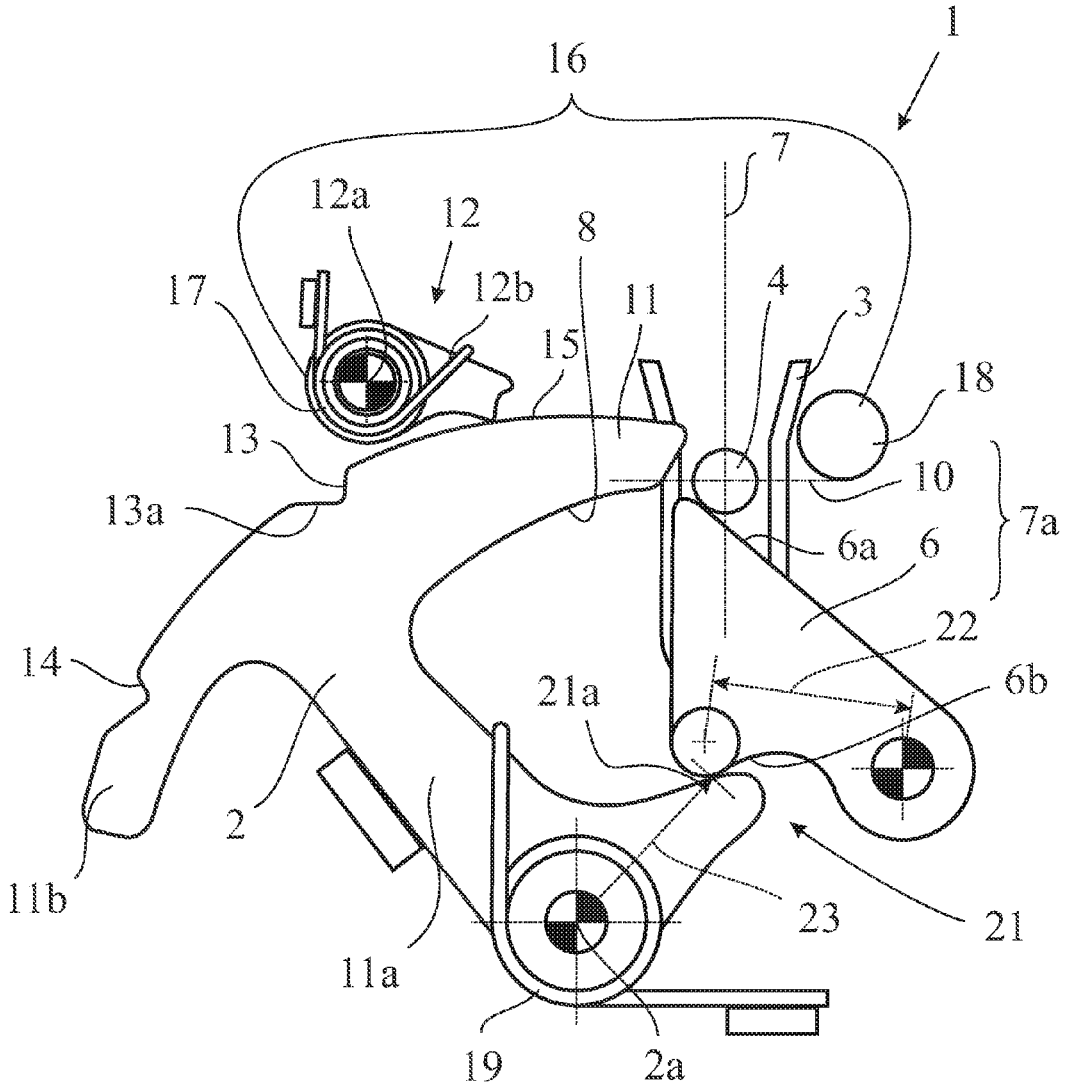
FIG. 1 the components of a proposed motor vehicle lock as far as essential for the invention in the beginning of a closing cycle and FIG. 2 the motor vehicle lock according to FIG. 1 a) during the closing cycle when reaching the preliminary closed position of the catch and b) during the closing cycle when reaching the main closed position of the catch.

The motor vehicle lock 1 shown in the drawings is assigned to a motor vehicle door arrangement, which comprises a motor vehicle door. Regarding the broad interpretation of the expression "motor vehicle door" reference is made to the introductory part of the specification. Here and preferably the motor vehicle door is a side door of the motor vehicle.

The motor vehicle lock 1 comprises a catch 2, which is pivotable around a catch axis 2*a*. The motor vehicle lock 1 further comprises an inlet mouth 3 for a lock striker 4. The inlet mouth 3 may be constructed as a channel as shown in the drawings. Generally the inlet mouth 3 may as well just be a free area that allows the lock striker 4 to come into engagement with the catch 2 as will be described.

Usually the motor vehicle lock 1 in its installed state is arranged at the motor vehicle door, while the lock striker 4 is arranged at the body of the motor vehicle. Depending on the application this overall structure may be vice versa as well.

Accordingly, a movement of the lock striker 4 relative to the motor vehicle lock 1 here and preferably goes back on the movement of the door of the motor vehicle door arrangement.

The catch 2 can be brought into a preliminary closed position (FIG. 2*a*), into a main closed position (FIG. 2*b*) and into an open position (FIG. 1). The catch 2 as such in its closed positions (FIG. 2*a*, 2*b*) may hold the lock striker 4 by a holding engagement between the catch 2 and the lock striker 4. The direction of the holding forces acting from the lock striker 4 onto the catch 2 are indicated with reference number 5 in the drawings.

The expression "catch 2 as such" means here that the lock striker 4 is being held by the catch 2 alone. Accordingly, no additional catch 2 is provided to hold the lock striker 4. With this arrangement the resulting construction is simple and cost effective.

In its open position the catch 2 releases the lock striker 4 as shown in FIG. 1 such that the door of the motor vehicle door arrangement may be opened.

The closing cycle of the motor vehicle lock is initiated by closing the motor vehicle door as noted in the general part of the specification. During such a closing cycle the lock striker 4 comes into an actuating engagement with the motor vehicle lock 1 such that the catch 2 moves from its open position into the direction of its closed position, here and preferably into its closed position. This closed position may be the main closed position of the catch 2. However, it may also be the preliminary closed position of the catch 2, in which case a motorized closing aid may be provided that moves the catch 2 into its main closed position.

According to the proposed solution, an actuating element 6 is provided, which is at least slightly displaceable relative to the catch 2. The actuating element 2 is or may be drivingly coupled to the catch 2, which coupling provides a transmission gearing, in particular a lever gearing, such that during the closing cycle the actuating engagement of the lock striker 4 with the actuating element 6 causes driving the catch 2 from its open position (FIG. 1) into its main closed position (FIG. 2*b*) for establishing the holding engagement between the catch 2 and the lock striker 4. As noted above, driving the catch 2 only into the direction of the closed position or into the preliminary closed position may be foreseen here as well.

It is particularly interesting that during a closing cycle the lock striker 4 comes into engagement with the actuating element 6, before it comes into engagement, especially into holding engagement, with the catch 2, which opens considerable room for designing the acoustic characteristic.

In the embodiment shown, during the closing cycle, the lock striker 4 travels on a closing path 7 relative to the motor vehicle lock 1, wherein the holding forces 5 acting between the catch 2 and the lock striker 4 during the holding engagement are aligned to the closing path 7.

The catch 2 comprises a holding engagement surface 8 for the holding engagement with the lock striker 4. Preferably, during movement of the catch 2 from the open position into the main closed position the holding engagement surface 8 travels basically in a direction perpendicular to the closing path 7, in the drawings from left to right.

FIGS. 1, 2*a* and 2*b* in combination show that the catch 2 during its movement from its open position into its closed position, with its holding engagement surface 8, crosses a crossing section 7*a* of the closing path 7. It may also be taken from this combination of figures that during the closing cycle the lock striker 4 passes the crossing section 7*a* of the closing path 7 before the catch 2 crosses the crossing section 7*a*. This synchronization is of particular importance for the function of the proposed motor vehicle lock.

During the holding engagement between the lock striker 4 and the catch 2 (FIGS. 2*a*, 2*b*) the lock striker 4 is in a holding position 9 for the main closed position (and in a holding position 9*a* for the preliminary closed position). It is preferred now that the actuating engagement between the lock striker 4 and the actuating element 6, when seen along the closing path 7, is taking place before the lock striker 4 reaching the holding position 9 (respective the holding position 9*a*). The first location of actuating engagement is denominated with the reference number 10 for clarification. With this sequence the above noted synchronization is possible with simple construction as will be explained in detail later.

The above noted kinematics allow the catch 2 to be of basically hook shaped design with a hook portion 11 connected to a shaft portion 11*a*, wherein the hook portion 11 provides the holding engagement surface 8 for the holding engagement between the catch 2 and the lock striker 4. Here and preferably the hook portion 11 is extending basically laterally with regard to the shaft portion 11*a*.

Depending on the application a pawl 12, that is pivotable around a pawl axis 12*a*, may be provided, that is assigned to the catch 2. The pawl 12 may be brought into a blocking position (FIGS. 2*a*, 2*b*), in which it is in blocking engagement with the catch 2. In the blocking position the pawl 12 prevents the catch 2 from pivoting from the respective closed position into the direction of the open position.

The pawl 12 may also be deflected into a release position (FIG. 1), in which it releases the catch 2. Here and preferably the catch 2 comprises a preliminary notch 13 and a main notch 14 for the blocking engagement between the pawl 12 and the catch 2. It is most preferred that the at least one notch 13,14 is/are arranged on an outer contour 15 of the catch 2, in particular on an outer contour of the hook portion 11. In the shown embodiment at least the main notch 14 is arranged at an extension 11*b* of the hook portion 11. Here, the hook portion 11 and the extension 11*b* of the hook portion 11 extend from the shaft portion 11*a* into opposite directions.

In the preliminary closed position the striker 4 comes into engagement with a first holding engagement point 8*a*. In the main closed position, the striker 4 comes into engagement with a second holding engagement point 8*b*. Interesting is the fact that the second holding engagement point 8*b* is closer to the pivot axis 2*a* of the catch 2 than the first holding engagement point 8*b*. With this it is guaranteed that the two holding positions 9 (main closed position) and 9*a* (preliminary closed position) of the striker 4 are displaced to each other as needed.

It is apparent from the drawings that the distance between the preliminary notch 13, which is assigned to the preliminary closed position, and the main notch 14, which is assigned to the main closed position, is at least the distance between the above noted two holding engagement points 8*a*, 8*b*. This distance is fairly large, which may be advantageous as will be explained below.

During a closing cycle, first, the pawl 12 normally falls into engagement with the preliminary notch 13 and subsequently is being guided to a radially outer position, such that it can fall into engagement with the main notch 14. This guidance may be accomplished by the preliminary notch 13 itself, which is provided with a ramp 13*a* as shown in FIG. 1. In this case, the outer contour 15 between the preliminary notch 13 and the main notch 14 does not need to guide the pawl 12 anymore, such that it is mainly aligned to a circle around the pivot axis 2*a* of the catch 2.

In a very preferred embodiment not shown in the drawings the outer contour 15 between the preliminary notch 13 and the main notch 14 is a continuous connection between the ground of the preliminary notch 13 to the top of the main notch 14. This connection provides the function of the above noted ramp 13*a*. As it is stretched along the above noted, fairly large distance, the acceleration on the pawl 12 in the radial direction is low even with quick closing cycles which leads to a safe engagement of the pawl 12 with the main notch 14 and which also leads to low noise generation during the closing cycle.

The embodiment shown is provided with a special crash support arrangement 16 for those holding forces, that exceed a predetermined threshold and that lead to deformation of the motor vehicle lock. Those forces are assigned the direction of the holding forces 5 and act on the crash support arrangement 16 in particular when a deformation of the catch 2 or the pivot guide of the catch 2 has taken place. Such forces develop mainly in a crash situation, in particular because of crash accelerations.

The above noted crash forces here and preferably are supported by the crash support arrangement 16 via the outer contour 15 of the catch 2. Preferably this is the same outer contour 15 which comprises the above noted, at least one notch 13,14.

The crash support arrangement 16 comprises at least one support element 17,18. In order to achieve a symmetric support in view of the holding forces 5 it is further preferred that at least two crash support elements 17, 18 are arranged oppositely to each other with respect to the inlet mouth 3 for the lock striker 4.

In the embodiment shown, in order to achieve a compact design, the pawl 12 itself provides a crash support element 17. The other, in the above noted sense oppositely to the pawl 12 arranged crash support element 18 is designed as a simple bolt.

Figure 2:
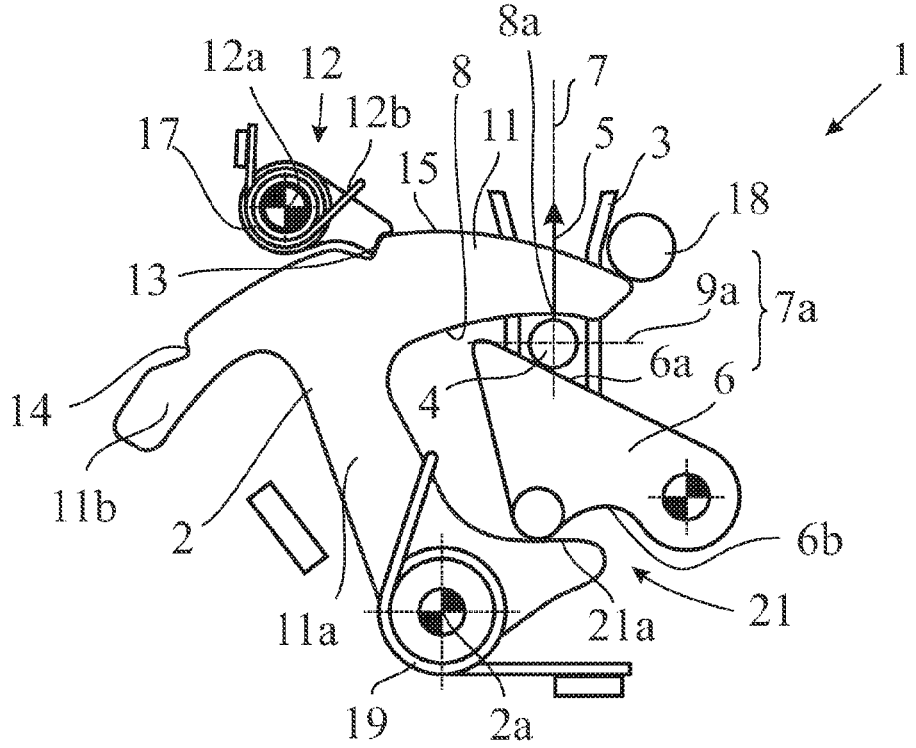
Figure 2:
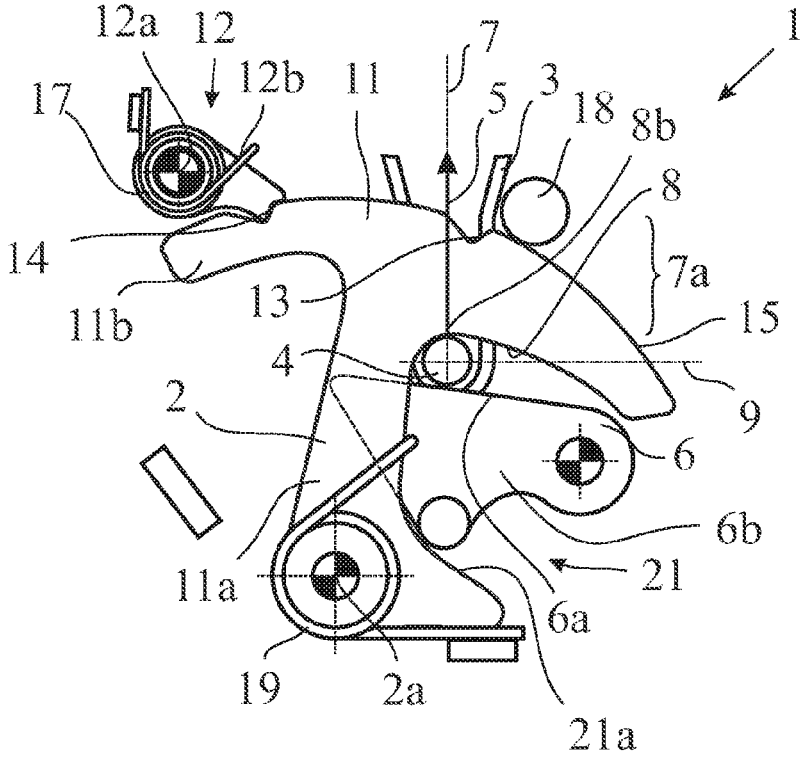

The embodiment shown in FIGS. 1 and 2 provides a spring bias of the catch 2, namely, in its open position the catch 2 is spring biased into its open position by an opening spring arrangement 19.

It is particularly interesting that in the embodiments shown in FIGS. 1, 2*a*, 2*b* during a closing cycle the lock striker 4 interacts only with the actuating element 6 before the holding engagement between the catch 2 and the lock striker 4 is established.

The proposed coupling between the actuating element 6 and the catch 2 provides a transmission gearing, in particular a lever gearing. Preferably, the transmission gearing is laid out such that only a small force acting from the lock striker 4 onto the actuating element 6 is necessary in order to move the catch 2 from its open position (FIG. 1) into its closed position (FIG. 2*b*). In particular the actuating element 6 is an actuating lever with an actuating surface 6*a* for engagement with the lock striker 4. Further preferably the actuating element 6 is provided with a transmission surface 6*b* for the engagement with the catch 2, which transmission surface 6*b* here and preferably is being realized by a bolt. For this engagement the catch 2 is provided with a transmission lever 21 with a corresponding counter transmission surface 21*a*.

Here and preferably, at least in the beginning of the closing cycle, the actuating surface 6*a* is inclined with respect to the closing path 7 to provide a wedge gearing between the striker 4 and the actuating element 6. Besides providing an additional transmission this inclination of the actuating surface 6*a* reduces the contact noise between the lock striker 4 and the actuating element 6 considerably. Preferably, the angle $\alpha$ between the actuating surface 6*a* and the closing path 7 is between 20° and 60°. The expression "inclination" is to be understood in a wide sense here. It clarifies that there is an inclination between the actuating surface 6*a* and the closing path 7 at the point of contact between the striker 4 and the actuating element 6. This inclination may vary during the course of the closing cycle, especially if the actuating surface 6*a* is not ideally planar but curved or the like.

The transmission surface 6*b* of the actuating element 6, during a closing cycle, engages a counter transmission surface 21*a* of the catch 2, thereby driving the catch 2 into the direction of its closing position. Preferably, during a closing cycle, the actuating element 6 with its transmission surface 6*b* slides along the counter transmission surface 21*a* of the catch 2. Generally, however, it is possible that the actuating element 6 is linked to the catch 2 by a joint or the like.

In order to reduce the necessary force from the lock striker 4 onto the transmission lever 21 it is proposed that the gearing between the actuating element 6 and the catch 2 provides a torque converter, such that a torque applied on the actuating element 6 is being converted into a higher torque at the catch 2. Here and preferably the effective gearing lever 22 on the side of the actuating lever 6 is accordingly shorter than the effective gearing lever 23 on the side of the catch 2. The expression "effective" means that only those parts are taken into account that provide a part of the resulting transmission gearing.

With the catch 2 in its open position the actuating element 6, here the actuating lever 6, crosses the inlet mouth 3. This guarantees that during the closing cycle the lock striker 4 comes into actuating engagement with the actuating element 6 as noted above. For this effect it can also be sufficient that the actuating lever 6, which comprises the actuating surface 6*a*, extends somewhat into the inlet mouth 3.

Further preferred in the embodiment shown in FIGS. 1, 2*a*, 2*b* is the fact that the catch 2 is biased into its open position by an above noted opening spring arrangement 19. The synchronization of the bias of the opening spring arrangement 19 with the "affordable" force acting from the lock striker 4 onto the actuating element 6 is of particular importance for the function of the proposed motor vehicle lock.

Finally it may be pointed out that due to using a hook shaped catch the resulting forces on the pawl in its blocking position are comparably low. Actuation of the pawl, be it manually or motor driven, requires only low actuation forces.

We claim:

1. A motor vehicle lock for a motor vehicle door arrangement, comprising a pivotable catch and an inlet mouth for a lock striker, wherein the pivotable catch can be brought into at least one closed position and into at least one open position, wherein the pivotable catch in the at least one closed position of the pivotable catch holds the lock striker by a holding engagement between the pivotable catch and the lock striker and in the at least one open position releases the lock striker, wherein during a closing cycle the lock striker comes into an actuating engagement with the motor vehicle lock such that the pivotable catch moves from the at least one open position of the pivotable catch into the direction of the at least one closed position, wherein an actuating element is provided, which is displaceable relative to the pivotable catch and which is drivingly coupled to the pivotable catch during the closing cycle, which coupling provides a transmission gearing, such that during the closing cycle the actuating engagement of the lock striker with the actuating element causes driving the pivotable catch from the at least one open position of the pivotable catch into the direction of the at least one closed position of the pivotable catch for establishing the holding engagement between the pivotable catch and the lock striker, wherein during the closing cycle the lock striker travels on a closing path relative to the motor vehicle lock and a portion of the pivotable catch fully travels across the closing path such that the pivotable catch holds the lock striker in the holding engagement, and wherein during the closing cycle the lock striker comes into engagement with the actuating element, before the lock striker comes into engagement with the pivotable catch, and wherein the transmission gearing is such that when the actuating element rotates in a first direction, the pivotable catch rotates in an opposite second direction.

2. A motor vehicle lock according to claim 1, wherein holding forces acting between the pivotable catch and the lock striker during the holding engagement are aligned mainly to the closing path.

3. A motor vehicle lock according to claim 1, wherein the pivotable catch comprises a holding engagement surface for the holding engagement with the lock striker.

4. A motor vehicle lock according to claim 3, wherein the pivotable catch is of a basically hook shaped design with a hook portion connected to a shaft portion and that the hook portion provides the holding engagement surface for the holding engagement between the pivotable catch and the lock striker.

5. A motor vehicle lock according to claim 4, wherein at least one notch is arranged on an outer contour of the pivotable catch and that the outer contour is arranged at the hook portion and/or at an extension of the hook portion.

6. A motor vehicle lock according to claim 5, wherein the hook portion and the extension of the hook portion extend form the shaft portion into the opposite directions.

7. A motor vehicle lock according to claim 4, wherein the hook portion is extending basically laterally with regard to the shaft portion.

8. A motor vehicle lock according to claim 3, wherein during movement the pivotable catch from the at least one open position into the at least one closed position the holding engagement surface travels basically in a direction perpendicular to the closing path of the lock striker.

9. A motor vehicle lock according to claim 1, wherein the pivotable catch travels across the closing path through a crossing section of the closing path, and wherein during the closing cycle the lock striker passes the crossing section of the closing path before the pivotable catch travels through the crossing section.

10. A motor vehicle lock according to claim 1, wherein during the holding engagement between the lock striker and the pivotable catch, the lock striker is in a holding position and the actuating engagement between the lock striker and the actuating element, when seen along the closing path, is taking place before the lock striker reaching the holding position.

11. A motor vehicle lock according to claim 1, wherein a pivotable pawl is assigned to the pivotable catch, wherein the pawl may be brought into a blocking position, in which the pawl is in blocking engagement with the pivotable catch in the at least one closed position of the pivotable catch and wherein the pivotable pawl may be deflected into a release position, in which the pivotable pawl releases the pivotable catch.

12. A motor vehicle lock according to claim 9, wherein the pivotable catch comprises at least one notch for the blocking engagement between the pivotable pawl and the pivotable catch.

13. A motor vehicle lock according to claim 1, wherein the at least one closed position of the pivotable catch includes a preliminary closed position, in which the lock striker comes into engagement with a first holding engagement point and a main closed position, in which the lock striker comes into engagement with a second holding engagement point, wherein the second holding engagement point is closer to a pivot axis of the pivotable catch than the first holding engagement point.

14. A motor vehicle lock according to claim 13, wherein the distance between a preliminary notch arranged on the pivotable catch, which is assigned to the preliminary closed position, and a main notch arranged on the pivotable catch, which is assigned to the main closed position, is at least the distance between the first holding engagement point and the second holding engagement point.

15. A motor vehicle lock according to claim 14, wherein an outer contour between the preliminary notch and the main notch is a continuous connection between a ground of the preliminary notch to a top of the main notch, or, wherein the outer contour between the preliminary notch and the main notch is mainly aligned to a circle around the pivot axis of the pivotable catch.

16. A motor vehicle lock according to claim 1, wherein a crash support arrangement is provided and wherein holding forces, that exceed a predetermined threshold and that lead to deformation of the motor vehicle lock, are supported by the crash support arrangement.

17. A motor vehicle lock according to claim 16, wherein the crash support arrangement comprises at least one crash support element that is engageable by the pivotable catch.

18. A motor vehicle lock according to claim 1, wherein in the at least one open position of the pivotable catch, the pivotable catch is spring biased into the at least one open position by an opening spring arrangement.

19. A motor vehicle lock according to claim 1, wherein the actuating element is an actuating lever with an actuating surface for engagement with the lock striker and a transmission surface for the engagement with the pivotable catch.

20. A motor vehicle lock according to claim 19, wherein at least in a beginning of the closing cycle the actuating surface is inclined with respect to the closing path to provide a wedge gearing between the lock striker and the actuating element.

21. A motor vehicle lock according to claim 20, wherein an angle ($\alpha$) between the actuating surface and the closing path is between 20° and 60°.

22. A motor vehicle lock according to claim 19, wherein the transmission surface of the actuating element, during the closing cycle, engages a counter transmission surface of the pivotable catch.

23. A motor vehicle lock according to claim 22, wherein during the closing cycle, the transmission surface of the actuating element slides along the counter transmission surface of the pivotable catch.

24. A motor vehicle lock according to claim 19, wherein the actuating lever extends into the inlet mouth.

25. A motor vehicle lock according to claim, wherein the transmission gearing between the actuating element and the pivotable catch provides a torque converter increasing the torque applied on the actuating element.

26. A motor vehicle lock according to claim 17, wherein an effective gearing lever on the side of the actuating lever is shorter than an effective gearing lever on the side of the pivotable catch.

27. A motor vehicle lock according to claim 1, wherein with the pivotable catch in the at least one position of the pivotable catch the actuating element extends into the inlet mouth.

* * * * *